US006907715B2

(12) United States Patent
Ballestrazzi et al.

(10) Patent No.: US 6,907,715 B2
(45) Date of Patent: Jun. 21, 2005

(54) DEVICE FOR STRETCHING A FILM IN AN AUTOMATIC PRODUCT PACKAGING MACHINE

(75) Inventors: Aris Ballestrazzi, Savignano sul Panaro (IT); Lamberto Tassi, Savignano sul Panaro (IT)

(73) Assignee: Sitma S.p.A., Spilamberto-Modena (IT)

( * ) Notice: Subject to any disclaimer, the term of this patent is extended or adjusted under 35 U.S.C. 154(b) by 0 days.

(21) Appl. No.: 10/403,118

(22) Filed: Mar. 31, 2003

(65) Prior Publication Data

US 2003/0188516 A1 Oct. 9, 2003

(30) Foreign Application Priority Data

Apr. 3, 2002 (IT) ..... MI2002A0686

(51) Int. Cl.[7] ..... B65B 9/06
(52) U.S. Cl. ..... 53/550
(58) Field of Search ..... 53/547, 550, 251

(56) References Cited

U.S. PATENT DOCUMENTS 3,589,091 A * 6/1971 Cloud ..... 53/399
3,973,372 A * 8/1976 Omori ..... 53/441
4,592,193 A * 6/1986 Gustavsson ..... 53/530
5,070,993 A * 12/1991 Fransen ..... 198/419.3
5,547,004 A * 8/1996 Fransen ..... 198/419.3
6,594,974 B2 * 7/2003 Theriault ..... 53/500

FOREIGN PATENT DOCUMENTS

EP 0 537 844 A1 4/1993
EP 0 640 526 A1 3/1995
EP 0 712 782 A1 5/1996
EP 0 875 455 A1 11/1998

OTHER PUBLICATIONS

EP Search Report.

* cited by examiner

*Primary Examiner*—John Paradiso
(74) *Attorney, Agent, or Firm*—Hedman & Costigan, P.C.

(57) ABSTRACT

A device for stretching a film in an automatic product packaging machine, in particular products (12) of any thickness and size, spaced from each other at a pre-set distance, which are fed by a first conveyor belt (14) to a second conveyor belt (19) combined with a wrapping film feeder (26, 28) and elements (34, 35) for sealing the film wrapped over the products (12), in which the device comprises elements (25) for stretching the film (26) at the inlet of the second conveyor belt (19) and an element (29–33) that engages the stretched film (26) on the second conveyor belt (19).

7 Claims, 1 Drawing Sheet

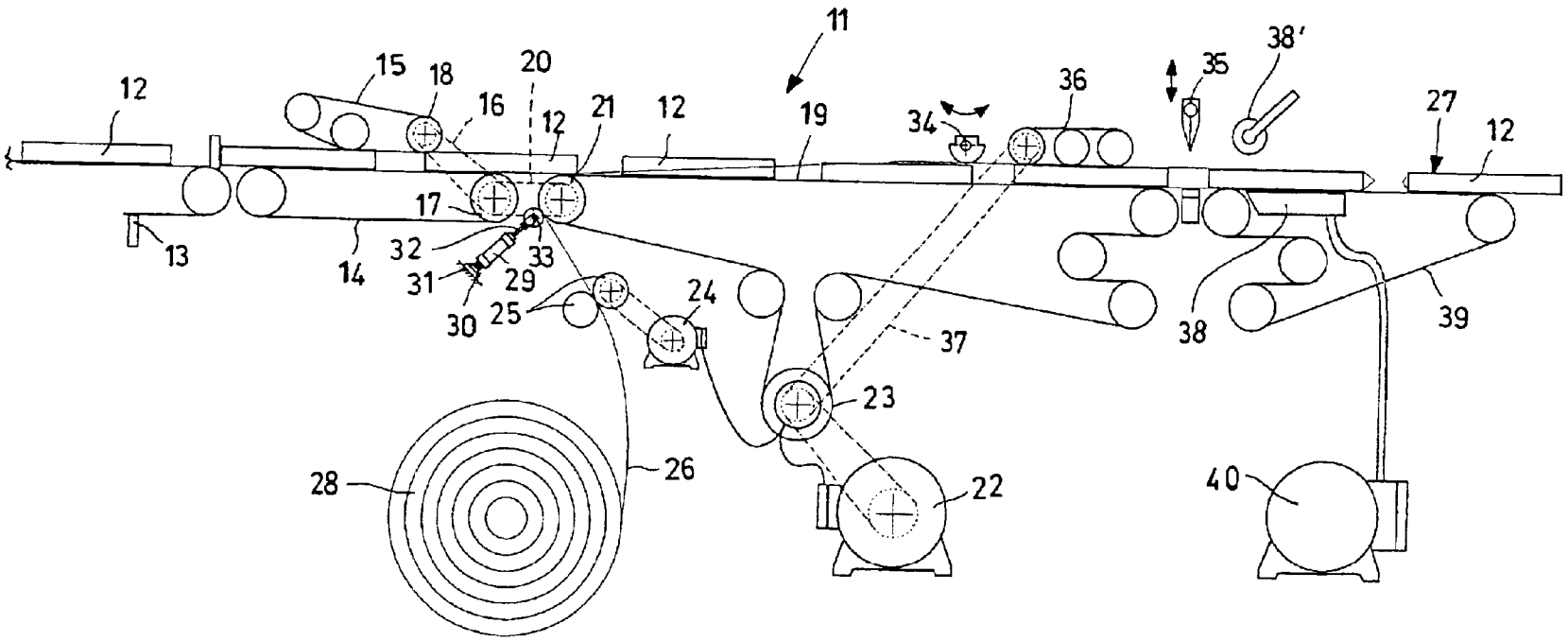
11
12
13
14
15
16
17
18
19
20
21
22
23
24
25
26
27
28
29
30
31
32
33
34
35
36
37
38
38'
39
40

DEVICE FOR STRETCHING A FILM IN AN AUTOMATIC PRODUCT PACKAGING MACHINE

The present application claims priority to Italian patent Application Serial No. MI 2002A 000686, filed Apr. 3, 2002.

BACKGROUND OF THE INVENTION

The present invention refers to a device for stretching a film in an automatic product packaging machine, in particular products of any thickness and size.

In the current method of distribution of publications such as envelopes, newspapers, magazines and books, with or without gadgets, wrapped in plastic and similar, there is the problem of packaging the products to facilitate automatic handling. This is particularly important in the field of postal sorters that do not accept film-packaged items where there is an excess of film with respect to the product, which in general causes jamming.

For said purpose the products must not be allowed to move freely inside the wrapping film as this prevents automatic handling.

This problem becomes even more evident when the film also contains additional inserts that tend to move, if the film does not tightly envelop the entire contents of the package.

Furthermore, it should not be forgotten that loose wrapping of the film on the products inside the package involves the use of more film than necessary which, with the large quantities used, involves an increase in packaging costs.

It should also not be forgotten that the variability in size and thickness of the packages does not always make it easy to obtain a tidy package in which the material inside can be checked by the packaging machine devices.

SUMMARY OF THE INVENTION

It is therefore the general aim of this invention to identify and produce a device for stretching a film in an automatic product packaging machine which solves all the above-mentioned technical problems.

A further aim of the invention is to produce a device of the type specified above that operates with any product thickness and size, without any problem.

A further aim of the invention is to produce a device that permits a certain saving on film, while performing correct accurate product packaging.

A further aim of the present invention is to produce a device that can be directly combined with a packaging machine already in use.

Yet another aim is to identify a device that makes performance of the correct packaging operations and, above all, subsequent handling of the packages thus obtained as automatic and rapid as possible.

These and other aims according to the present invention are achieved by producing a device for stretching a film in an automatic product packaging machine in particular products (12) of any thickness and size, spaced from each other at a pre-set distance, which are fed from a first conveyor belt (14) to a second conveyor belt (19) combined with a wrapping film feeder (26, 28), an oscillating longitudinal sealer (34) and a transverse sealer (35) for sealing said film wrapped over said products (12), wherein said device comprises a pair of drive rollers (25) for stretching said film (26) at the inlet of said second conveyor belt (19) and a cylinder (29) attached to a stem (32) fitted with an idle pressure roller (33) which engages said stretched film (26) on said second conveyor belt (19).

Further relevant characteristics of the present invention are illustrated in the subordinate claims.

The device according to the present invention therefore ensures correct packaging at all times of the products that arrive in succession spaced on a feed conveyor belt which conveys them, once packaged, to the subsequent handling and shipping operations.

BRIEF DESCRIPTION OF THE DRAWINGS

It should be noted that said device can be rapidly adapted to packaging lines already in use.

The functional and structural characteristics and the advantages of a device according to the invention will become more evident from the description of a form of embodiment illustrated as an non-restrictive example, with reference to the attached FIGURE. Said FIGURE shows schematically, in a side elevation view, a device for stretching a film in a machine for automatic packaging of products fed in succession, which is positioned between a first conveyor belt for feeding said products and a second conveyor belt which seals them in a film.

DETAILED DESCRIPTION OF THE INVENTION

With reference to the drawing, a device for stretching a film in an automatic product packaging machine according to the present invention is shown, indicated overall by number 11, which is fed with products, schematised in 12, of any thickness and dimension. These products 12 can be either single products or several products combined, also of different sizes, for packaging in the same film.

The products 12, moved forward by a piston conveyor 13, are arranged on a first feed conveyor belt 14, on which they are spaced from each other by means of an upper spacer belt 15 which spaces the products 12 in succession. The spacer belt 15 is synchronised on roller 18 by a transmission 16 connected to a roller 17 of the first feed conveyor belt 14.

A further roller 21 of a second conveyor belt 19, positioned after the first belt 14, is synchronised by a transmission 20 connected to a roller 17 of the first conveyor belt 14.

The second conveyor belt 19 is controlled by a motor 22, connected to an encoder 23, to which a second motor 24 is connected, in its turn, controlling a pair of drive rollers 25.

According to the invention, these rollers 25 feed a film 26 at a lower speed than that of the second conveyor belt 19, thus acting as stretching elements for the film. Said speed of the pair of rollers 25 can be adjusted and correlated with that of the second conveyor belt (19).

This film is unwound from a reel 28 and serves to produce a finished package 27 at the outlet of the packaging machine, shown only partly.

According to the invention, furthermore, a cylinder 29 is provided, integral with a supporting structure 31 of the packaging machine by means of a pin 30 located at one end. A stem 32 protrudes, controlled by the cylinder 29, and is fitted with an idle pressure roller 33, which engages on the film positioned on the second conveyor belt 19. This pressure roller 33 forces the film 26 to move forward from that point of contact with the second conveyor belt 19 at the same speed as said conveyor belt 19, thus creating an element that engages the film 26 on the second conveyor belt 19.

Alternatively, this engagement element can be a simple roller which engages via an elastic element or similar, of the adjustable type.

Naturally, as already said, the travel speed of the second conveyor belt 19 is higher than that of the pair of drive rollers 25 of the film 26, thus stretching the film 26.

The stretched film 26 moves forward on the second conveyor belt 19 and wraps in tubular fashion around the products 12 which are moving forward. An oscillating longitudinal sealer 34 and a transverse sealer 35, which is raised and lowered, enclose the product 12 inside the stretched film. They operate in conjunction with a pressure belt 36 which is controlled at the same travel speed as the second conveyor belt 19 by means of a transmission 37 which connects it to the encoder 23 and to the main motor 22. The pressure belt 36 also helps to keep the film 26 stretched.

Alternatively, the pressure belt 36 can be replaced by a belt with suction which is particularly useful for irregularly shaped products which must not be subjected to pressure. In this case the conveyor belt 19 can also be provided with a suction area corresponding to the upper suction belt 36. All these elements constitute further means for maintaining the film stretched during the packaging and sealing phases with the product inside the film.

Immediately downstream of the transverse sealer 35 a suction box 38 is provided, connected to a vacuum pump 40, which exerts suction on the product contained in the partially sealed film via a perforated conveyor belt 39. This suction keeps the film 26 taut until the product has been finally sealed, after which it is de-activated and the packaged product, i.e. the package 27, is released.

Alternatively to the suction box 38 an engagement roller 38' can be provided which engages on the product contained in the film 26 positioned on a conveyor and keeps the film taut until transverse sealing has been completed and the product is completely packaged in the film.

This set of pressure elements or elements keeping the film tensioned or stretched guarantees a well-tensioned film until completion of longitudinal and transverse sealing of the film on the product, with well-tensioned final packaging.

The packaging obtained according to the present device is therefore free from all the disadvantages that previously limited its functionality.

In fact, the elimination of parts of film protruding from the packaging prevents obstruction of automatic package handling systems, thus avoiding jamming of the handling machine.

Stretching of the film, in fact, ensures that the film fully adheres to the product which also looks neat and well-packaged.

Furthermore, if inserts or other are combined with the product being packaged, they are well-secured in the film which, since it is stretched, adheres to the whole contents and, on release, adapts to the contents, thereby securing them.

Said use of the film which is placed stretched over the products, also offers a considerable saving on film during packaging. This saving on large quantities used for packaging involves a reduction in packaging costs.

It should also be remembered that said device can be easily installed also on existing packaging machines. In fact, it is sufficient to fit the component parts without having to modify the structure of the machine.

It is possible to obtain the required stretching by simply adjusting the pair of drive rollers 25. In fact, a reduction or an increase in their speed with respect to the travel speed of the second conveyor belt 19 permits setting of the required degree of stretching.

It is obvious that the term "product" indicates a packaged or non-packaged product, single or composite with varying thickness, in the form of a publication or otherwise, for insertion into a film. Furthermore, as already said, the basic product, such as a newspaper, a magazine, a book or other, can be combined with at least one second product, of equal or different dimensions, that acts as an additional element, such as any type of gadget, a compact disc, a floppy disc, a perfume, or any other object of fairly limited size.

It is therefore evident that the present invention offers a simple convenient solution to the general problem previously referred to.

The stretching device of the present invention thus conceived is subject to numerous modifications and variations which all fall within the scope of the invention.

Furthermore, in practice the materials used, in addition to their dimensions and the components, may be of any type according to technical requirements.

What is claimed is:

1. A device for stretching a film in an automatic product packaging machine, for products (12) of any thickness and size, spaced from each other at a pre-set distance, said device comprising a first conveyor belt (14) which feeds said products (12) to a second conveyor belt (19) combined with a wrapping film feeder (26, 28), an oscillating longitudinal sealer (34) and a transverse sealer (35) for sealing said film over said products (12), wherein said device further comprises a pair of drive rollers (25) for stretching said film (26) at the inlet of said second conveyor belt (19) and a cylinder (29) attached to a stem (32) fitted with an idle pressure roller (33) which engages said stretched film (26) on said second conveyor belt (19).

2. Device according to claim 1, wherein said pair of rollers (25) feeds said film (26) at a travel speed lower than that of said second conveyor belt (19).

3. Device according to claim 2, wherein said travel speed of said pair of rollers (25) can be adjusted and correlated with said second conveyor belt (19).

4. Device according to claim 1, wherein said pair of rollers (25) is controlled by a motor (24) connected to an encoder (23) wherein said encoder (23) is connected to a main motor (22) of said packaging machine or of said second conveyor belt (19).

5. Device according to claim 1, further comprising elements for maintaining said film, said elements comprising a pressure belt (36) which is controlled at the same travel speed as the second conveyor belt (19).

6. Device according to claim 1, further comprising elements for maintaining said film said elements comprising, downstream of a transverse sealer (35), a suction box (38) which exerts suction on said product (12) contained in said partially sealed film (26) via a perforated conveyor belt (39).

7. Device according to claim 1, further comprising elements for maintaining said film said elements comprising, downstream of a transverse sealer (35), an engagement roller (38') that engages on said product (12) contained in said partially sealed film (26) transported by a conveyor (39).

* * * * *